US005217601A

United States Patent [19]

Nakada et al.

[11] Patent Number: 5,217,601

[45] Date of Patent: Jun. 8, 1993

[54] METHOD FOR IMPARTATION OF BLUE COLOR TO ALUMINUM OR ALUMINUM ALLOY

[75] Inventors: Norio Nakada, Toyama; Hideo Fukui, Kurobe; Hatsuo Hirono, Toyama; Seishiro Ito, Ikoma, all of Japan

[73] Assignee: Yoshida Kogyo K. K., Tokyo, Japan

[21] Appl. No.: 894,586

[22] Filed: Jun. 5, 1992

[30] Foreign Application Priority Data

Jun. 11, 1991 [JP] Japan ..... 3-165221

[51] Int. Cl.[5] ..... C25D 11/14

[52] U.S. Cl. ..... 205/324; 205/328

[58] Field of Search ..... 205/324, 328

[56] References Cited

U.S. PATENT DOCUMENTS 4,024,039 5/1977 Yoshida et al. .

FOREIGN PATENT DOCUMENTS 235081 4/1986 German Democratic Rep. .
51-35177 9/1976 Japan .
52-5010 2/1977 Japan .
54-23657 2/1979 Japan .
1379798 1/1975 United Kingdom .
2242201 9/1991 United Kingdom .

*Primary Examiner*—T. M. Tufariello
*Attorney, Agent, or Firm*—Hill, Steadman & Simpson

[57] ABSTRACT

Durable and clear blue color of freely controlled density can be expeditiously and efficiently impated to an anodic oxide film of aluminum by a method which comprises forming the anodic oxide film on the aluminum or aluminum alloy, then subjecting the aluminum or aluminum alloy to AC electrolysis in a bath containing an inorganic ferrous salt as a main component thereof thereby inducing deposition of iron in the pores of the oxide film, and subsequently placing the aluminum or aluminum alloy as an anode in a bath containing hexacyano iron (II) acid salt as a main component thereof and subjecting the same to DC electrolysis therein. In the alternative method, the pore-widening treatment is added next to said step of anodic oxidation. The pore-widening treatment is effected by immersing the aluminum or aluminum alloy in sulfuric acid or phosphoric acid or electrolyzing the same in phosphoric acid or a mixed solution of phosphoric acid and sulfuric acid.

10 Claims, No Drawings

METHOD FOR IMPARTATION OF BLUE COLOR TO ALUMINUM OR ALUMINUM ALLOY

BACKGROUND OF THE INVENTION

1. Field of the Invention

This invention relates to a method for the impartation of blue color to aluminum or an aluminum alloy (hereinafter referred to collectively as "aluminum").

2. Description of the Prior Art

Heretofore, as means to impart blue color to aluminum which has undergone the treatment for formation of an anodic oxide film, several methods centering around the electrolytic coloring process have been known and the method of coloration by immersion using inorganic compounds and other methods using dyes have been known as well.

In these conventional techniques, however, the electrolytic coloring process produces clear blue color only with difficulty. On the other hand, the method of coloration by immersion using an inorganic compound entails the disadvantage that the coloring substance used therein does not easily permeate to the depth of micropores of the anodic film which in turn results in the discoloration of the treated aluminum and the contamination of the bath in the aftertreatment. It is also difficult to obtain within a short span of time the impartation of blue color of desired density to the anodic oxide film produced by the conventional method. By the method of dyeing, it is difficult to attain durable coloration of the anodic oxide film of medium thickness (about 10 μm).

As measures to solve these problems, Japanese Patent Publication No. SHO 52-5010 proposes a method for effecting the coloration of aluminum by subjecting aluminum to anodic oxidation in an aqueous phosphoric acid solution and immersing the treated aluminum in a bath of fine dispersion of an aqueous pigment thereby inducing adsorption of the pigment to a porous anodic oxide film formed on the surface of aluminum or a method which further coats the colored aluminum obtained as described above with a thermosetting resin, Japanese Patent Publication No. SHO 51-35177 proposes a method for attaining the coloration of aluminum by immersing aluminum which has undergone anodic oxidation in a nonionic or nonionic-cationic bath of fine dispersion of an aqueous organic pigment and passing a direct current or an alternating current through the aluminum in the bath thereby inducing adsorption of the pigment to a porous anodic oxide film formed on the surface of aluminum or a method which further coats the colored aluminum obtained as described above with a thermosetting resin. These patent publications disclose working examples which attained coloration of an anodic oxide film of aluminum in blue.

These patent publications teach that the fine dispersion of the pigment having a particle size falling in the neighborhood of 1 μm (1,000 nm), preferably not exceeding 0.5 μm (500 nm) is used. The anodic oxide film for which the fine dispersion of the pigment is to be used generally has a pore diameter of not more than 50 nm. Since most pigment particles are larger than the pore diameter, therefore, the coloration of aluminum occurs in such a manner that the pigment is deposited by adsorption in a layer in the mouths of pores in the anodic oxide film and on the surface of the oxide film. The colored and pore-sealed aluminum of such a method, therefore, poses a problem of poor fastness of the imparted color to the impact of abrasion and consequent ready release of the pigment and, moreover, entails the disadvantage that fast coloration is not obtained unless the colored oxide film is coated with resin as disclosed in the patent publications mentioned above.

SUMMARY OF THE INVENTION

Accordingly, a principal object of this invention is to provide a method of coloration which is capable of imparting clear and durable blue color of freely controlled density by a simple procedure to an anodic oxide film of medium thickness desired to be formed on facing aluminum materials used in buildings.

Another object of this invention is to stabilize coloration of aluminum by the use of a bath stable to preclude otherwise inevitable defilement.

Still another object of this invention is to provide a method of coloration which is capable of imparting clear and dense blue color to an anodic oxide film of aluminum.

To accomplish the objects described above, the first aspect of this invention resides in providing a method for the impartation of blue color to aluminum, characterized by comprising the steps of forming an anodic oxide film on aluminum by DC electrolysis as conventionally practised, then subjecting the resultant anodized aluminum to AC electrolysis in a bath containing an inorganic ferrous salt as a main component thereof thereby inducing deposition of iron in the pores of said anodic oxide film, and subsequently subjecting the treated aluminum to DC electrolysis in a bath containing a hexacyano iron (II) acid salt as a main component thereof and using said aluminum as an anode.

The second aspect of this invention resides in providing a method for the impartation of clear and dense blue color to aluminum, characterized by comprising the steps of forming an anodic oxide film on aluminum by DC electrolysis as conventionally practised, then subjecting the resultant anodized aluminum to a pore-widening treatment resorting to immersion in sulfuric acid or phosphoric acid or electrolysis in phosphoric acid or a mixed solution of phosphoric acid and sulfuric acid, subsequently subjecting said aluminum to AC electrolysis in a bath containing an inorganic ferrous salt as a main component thereof thereby inducing deposition of iron in the pores of said anodic oxide film, and thereafter subjecting the treated aluminum to DC electrolysis in a bath containing a hexacyano iron (II) acid salt as a main component thereof and using said aluminum as an anode.

DETAILED DESCRIPTION OF PREFERRED EMBODIMENTS

This invention provides a method for obtaining impartation of durable blue color of freely controlled density by an expeditious procedure to an anodic oxide film produced by the conventional method. First, a description will be given to the first method of this invention. This first method comprises a series of steps of conventional pretreatment→anodic oxidation→treatment for deposition of iron→DC electrolysis in a bath of hexacyano iron (II) acid salt and is characterized in that the treatment for deposition of iron allows iron to be deposited in an amount necessary for coloration in the pores of an anodic oxide film of aluminum obtained by the conventional method and the treated aluminum is subjected to DC electrolysis in a bath of hexacyano iron (II) acid salt so as to obtain the impartation of blue color. Specifically, the first step consists in forming an anodic oxide film on aluminum by DC electrolysis carried out as conventionally practised, the second step subjecting the resultant anodized aluminum to AC electrolysis in a solution containing ferrous ions thereby attaining deposition of iron in an amount necessary for coloration in the pores of the oxide film, and the third step subjecting the aluminum to DC electrolysis in a bath of hexacyano iron (II) acid salt using said aluminum as an anode thereby causing hexacyano iron (II) acid iron migrated into the pores of the anodic oxide film by electrophoresis to react with iron ion within the pores of said oxide film and consequently inducing deposition of a blue color compound within the pores and giving rise to a blue oxide film excellent in durability.

Now, various manners for embodying the method depicted above will be more specifically described below. First, the aluminum is given suitable pretreatments such as degreasing, etching, and neutralization and then subjected to the well-known treatment for anodic oxidation to give rise to an anodic oxide film. To be specific, in the well-known electrolytic solution of a mineral acid and/or organic acid, i.e. the electrolytic solution containing sulfuric acid, chromic acid, phosphoric acid, or a mixed acid thereof, oxalic acid, or any of mixed acids using oxalic acid and/or the aforementioned mineral acids, generally in the aqueous sulfuric acid solution, the aluminum is subjected to the treatment for anodic oxidation using direct current. The voltage to be applied and the duration of this application for this treatment of anodic oxidation may be the same as those in the conventional method.

By performing the AC electrolysis in a solution containing a ferrous ion subsequently to said treatment for anodic oxidation, iron is deposited in the bottom parts of pores of the oxide film in an amount necessary for the production of blue color of desired density. When adsorption of a small amount of ferric ion in the pores of the oxide film is effected simultaneously with the deposition of iron in this case, the reaction for coloration in the subsequent step is facilitated. As a suitable bath for fulfilling such conditions as facilitating the adsorption of the ferric ion, diminishing possible change of pH, and discouraging sedimentation, any of the following baths may be adopted. The first bath is prepared by using ferrous sulfate or ferrous ammonium sulfate as a main component in a ratio in the range between 10 and 200 g/liter, preferably between 10 and 100 g/liter and additionally incorporating therein boric acid in a ratio in the range between 20 and 50 g/liter. When this bath is left standing for several days, it is stabilized with the pH value reaching a level in the range between 3 and 3.5. This stabilization is accelerated by addition of a small amount of ferric ion. Though any ferric salt may be used for this purpose, a sulfate proves particularly desirable. The concentration of the ferric sulfate may be in the range between 1 to 10 g/liter, preferably between 1 and 5 g/liter. The addition of boric acid serves the purpose of diminishing possible change of pH during the process of AC electrolysis and precluding possible difference in the degree of coloration. Though the deposition of iron is attainable so long as the pH of the bath falls in the range between 2 and 5, the pH of the bath is desired to be restricted to the range beyween 3 and 3.5 because the bath is liable to produce brown precipitate if the pH exceeds 3.5 and the bath requires a high voltage for the deposition of iron if the pH is less than 3.

The second suitable bath is prepared by using ferrous sulfate or ferrous ammonium sulfate as a main component in a ratio in the range between 10 and 200 g/liter, preferably between 10 and 100 g/liter, and additionally incorporating therein boric acid in a ratio in the range between 20 and 50 g/liter. Further, iron powder may be added to the bath in a ratio in the range between 0.5 and 10 g/liter, and at least one of such organic acids as tartaric acid, citric acid, gluconic acid and malic acid which are used as a masking agent for the iron and have no very strong complex-forming ability may be added in a ratio in the range between 0.1 and 1 g/liter to the bath. Though the pH of this bath may be anywhere between 3 and 6, the bath having a pH value between 4.5 and 5.5 is capable of effecting stable deposition of iron necessary for the coloration without requiring the addition of a ferric ion. Though the ferrous ion readily yields to oxidation because of a high pH value, the addition of the small amount of said masking agent serves the purpose of repressing the occurrence of sediment with the ferric ion. In this case, it is undesirable to use the organic acid in an unduly large amount because the organic acid in an ample supply interferes with the deposition of iron. The ferric ion which has been inhibited from generating sediment is reduced into the ferrous ion on contact with the iron powder. Further, the addition of boric acid serves the purpose of diminishing possible change of pH during the process of electrolysis and ensuring the production of blue color suffering sparingly from lack of uniformity, in much the same manner as in the first bath.

In the first or second bath described above, the amount of iron to be deposited can be controlled by applying an AC voltage between 5 and 35 V for a period between 15 and 300 seconds, preferably between 15 and 180 seconds, and thus the density of the blue color to be generated may be controlled by adjusting the amount of deposition mentioned above. To be more specific, the voltage is heightened and the duration of application of the voltage is lengthened to obtain the blue color of high density. These magnitudes are decreased to obtain the blue color of low density. The deposited iron partly remains unreacted in the next step if the amount of deposition is unduly large. The generating color tends to lose uniformity if the amount of deposition of iron is unduly small. Since the oxide film may be destroyed if the voltage is unduly high, as the optimum conditions for the coloration, the magnitudes under discussion are desired to be set within the pertinent range mentioned above.

Subsequently, in a bath of hexacyano iron (II) acid salt, the aluminum which has undergone the aforementioned treatment for deposition of iron is subjected to DC electrolysis using said aluminum as an anode, to obtain the desired impartation of blue color to the aluminum. Several hexacyano iron (II) acid salts are known to the art. Among hexacyano iron (II) acid salts, potassium ferrocyanide or ammonium ferrocyanide proves to be particularly desirable. The concentration of this ferrocyanide compound is desired to be in the range between 1 and 100 g/liter, preferably between 10 and 100 g/liter. By applying a DC voltage of not less than 25 V to the bath using said aluminum as an anode, the hexacyano iron (II) acid ion migrates into the pores of the anodic oxide film by electrophoresis and, at the same time, the iron deposited within the pores of the oxide film is dissolved in the form of ion into the solution, with the result that a blue color compound is formed inside the pores and the aluminum is colored in blue. At this time, the possible so-called "re-solution" of the produced blue color compound in the bath and the consequent defilement of the bath may be precluded by adding at least one of such inorganic strong electrolytes as sodium sulfate, potassium sulfate, sodium chloride, and potassium chloride in a ratio in the range between 20 and 50 g/liter. The pH of the bath has no discernible effect on the coloration and generally may be set in the range between 2 and 10. This pH nevertheless is desired to be retained in the range between 5 and 7 because the bath is suffered to assume a colloidal constitution if it has an alkaline pH value and it is liable to be discolored by photo-decomposition of hexacyano iron (II) acid ion if the pH value is kept at a low level.

The second method of this invention comprises a series of steps of conventional pretreatment→anodic oxidation→pore-widening treatment→treatment for desposition of iron→DC electrolysis in a bath of hexacyano iron (II) acid salt. It is, therefore, identical with the first method described above, excepting the pore-widening treatment is added next to the step of anodic oxidation. This pore-widening treatment is accomplished satisfactorily either by immersion in sulfuric acid or phosphoric acid or by electrolysis in phosphoric acid or a mixed bath of phosphoric acid and sulfuric acid, as generally practised. Owing to the addition of this particular step of treatment, the blue color oxide film produced by the second method excels that produced by the first method in point of clearness and density of color. The other component steps of the second method are carried out under the same conditions in the same manner as in the first method described above. The blue color oxide film formed as described above exhibits excellent resistance to light as compared with the oxide film colored by the method of immersion.

The anodic oxide film colored in blue in accordance with the present invention may be further subjected to the conventional pore-sealing treatment and/or the finish clear coating, as occasion demands.

Now, this invention will be described more specifically below with reference to working examples. As a matter of course, this invention is not limited to the following examples. It ought to be easily understood by any person of ordinary skill in the art that this invention allows various modifications within the scope of the spirit of this invention.

EXAMPLE 1

An extruded article of aluminum A6063 which had undergone the conventional pretreatments of degreasing, etching, and neutralization was subjected to DC electrolysis in the usual way in an aqueous solution containing 190 g/liter of sulfuric acid (20° C.) to form an anodic oxide film thereon in a thickness of 11 μm. Then, the resultant anodized article was set up as opposed to an stainless steel plate as a counter electrode in an aqueous solution (20° C., pH 3.0) containing 50 g/liter of ferrous ammonium sulfate, 30 g/liter of boric acid, and 1 g/liter of ferric sulfate and an alternating current of 15 V was applied between the anodized article and the stainless steel counter electrode for one minute to obtain a uniform brown oxide film. The resultant article was disposed as an anode in an aqueous solution (20° C., pH not yet adjusted) containing 20 g/liter of potassium ferrocyanide and 20 g/liter of sodium sulfate and a direct current of 35 V was applied between the article and the counter electrode for about 30 seconds. Consequently, a slightly darkened blue oxide film was obtained.

EXAMPLE 2

An extruded article of aluminum A6063 which had undergone the conventional pretreatments of degreasing, etching, and neutralization was subjected to DC electrolysis in the usual way in an aqueous solution containing 190 g/liter of sulfuric acid (20° C.) to form an anodic oxide film thereon in a thickness of 11 μm. Then, the resultant anodized article was kept immersed in a bath containing 100 g/liter of phosphoric acid (20° C.) for five minutes. In a bath prepared by keeping iron powder submerged in a ratio of 10 g/liter in an aqueous solution (20° C., pH 4.5) containing 50 g/liter of ferrous ammonium sulfate, 20 g/liter of boric acid, and 0.75 g/liter of tartaric acid, the anodized article was placed as opposed to a stainless steel plate as a counter electrode and then an alternating current of 10 V was applied therebetween for 30 seconds to obtain a uniform gray oxide film. Then, the resultant article was disposed as an anode in an aqueous solution (20° C., pH not yet adjusted) containing 20 g/liter of potassium ferrocyanide and 20 g/liter of sodium sulfate and a direct current of 35 V was applied between the article and the counter electrode for about 20 seconds. Consequently, a clear blue color oxide film was obtained.

EXAMPLE 3

Samples of the article of blue-colored aluminum obtained in Example 2 were severally subjected to a varying pore-sealing treatment indicated in Table 1 and then to a 100-hour exposure test with the aid of a dew panel weatherometer. The results are shown in Table 1. For comparison, the procedure of Example 2 was followed, excepting 3 minutes' immersion in a bath containing 20 g/liter of ferric sulfate was used in the place of the electrolysis in the ferrous sulfate bath before the coloration in the ferrocyanide bath. Samples of the product of this comparative experiment were subjected to the same pore-sealing treatment and the exposure test. The results are also shown in the same table.

TABLE 1

| Sample | | Before exposure | | | After Exposure | | | |
|---|---|---|---|---|---|---|---|---|
| | | L | a | b | L | a | b | ΔE |
| Sealing of pores with Ni salt | Example | 47.29 | −1.51 | −37.84 | 45.21 | −2.29 | −34.95 | (3.8) |
| | Comparative experiment | 50.15 | −3.48 | −35.77 | 56.05 | −9.19 | −28.68 | 10.8 |
| Sealing of pores with boiling water | Example | 46.80 | −2.13 | −37.87 | 44.15 | −0.21 | −33.04 | (5.5) |
| | Comparative experiment | 49.95 | −2.10 | −34.70 | 55.70 | −5.11 | −27.11 | 10.0 |

In the above Table 1, the symbol "ΔE" means a color difference in accordance with the Hunter's color difference formula. The symbol "L" is a psychometric lightness, and "a" and "b" are psychometric chroma coordinates in the Hunter's color difference formula. The color of the anodic oxide film was measured by means of a differential colorimeter (Model CR-300, made by Minolta Camera Co., Ltd.).

It is clearly noted from the results shown in Table 1 that the samples for comparison showed heavy color difference and increase in the magnitude of L (discoloration) after exposure, whereas the samples of example of this invention showed decrease in the magnitude of L and rather growth in density after exposure.

EXAMPLE 4

An extruded article of aluminum A6063 which had undergone the conventional pretreatment of degreasing, etching, and neutralization was subjected to DC electrolysis in the usual way in an aqueous solution containing 190 g/liter of sulfuric acid (20° C.) to form an anodic oxide film thereon in a thickness of 11 μm. Then, the resultant anodized article was subjected to a pore-widening treatment by setting in a mixed acid (20° C.) containing 100 g/liter of phosphoric acid and 10 g/liter of sulfuric acid and subjecting to five minutes' electrolysis therein with a DC of 10 V. In a bath prepared by keeping iron powder submerged in a ratio of 10 g/liter in an aqueous solution (20° C., pH 4.5) containing 50 g/liter of ferrous ammonium sulfate, 20 g/liter of boric acid, and 0.75 g/liter of tartaric acid, the resultant article was disposed as opposed to a stainless steel plate as a counter electrode, and then an alternating current of 10 to 15 V was applied therebetween for 0.5 to 3 minutes to obtain a uniform gray to brown oxide film. Subsequently, in an aqueous solution (20° C., pH not yet adjusted) containing 20 g/liter of potassium ferrocyanide and 20 g/liter of sodium sulfate, the resultant article was placed as an anode, and a direct current of 35 V was applied between the article and the counter electrode for about 20 to 40 seconds, to obtain a blue oxide film of desity proportionate to the duration of the electrodeposition of iron and the magnitude of voltage applied.

As described above, the method of this invention for the impartation of blue color allows efficient deposition of a blue color compound within the pores of an anodic oxide film proportionately to the desired density of color and, therefore, permits the impartation of blue color of freely controlled desity by a simple procedure. By the second method, clear and fairly dense blue color may be imparted to the oxide film of aluminum. The oxide film may be in the ordinary thickness (about 10 μm) to be effectively colored. The density of the blue color may be increased by using the conventional pore-widening treatment subsequently to the conventional treatment for anodic oxidation. Depending on the degree of coloration to be desired, the pore-widening treatment subsequent to the treatment for anodic oxidation may be omitted. Further, in accordance with the method of this invention, the imparted blue color excels in durability because the color component may be deposited even to the bottoms of the pores of the oxide film, and the stable coloration may be attained without the defilement of the bath.

What is claimed is:

1. A method for the impartation of blue color to aluminum or an aluminum alloy, comprising the step (A) of forming an anodic oxide film on said aluminum or aluminum alloy by DC electrolysis as conventionally practised and subsequently subjecting the resultant anodized aluminum or aluminum alloy to AC electrolysis in an aqueous solution containing an inorganic ferrous salt as a main component thereof thereby inducing deposition of iron in the pores of said anodic oxide film and the step (B) of placing said aluminum or aluminum alloy as an anode in an aqueous solution containing a hexacyano iron (II) acid salt as a main component thereof and subjecting the same to DC electrolysis therein.

2. A method according to claim 1, wherein said AC electrolysis in the step (A) of iron deposition subsequent to said anodic oxidation is carried out in an aqueous solution containing 10 to 200 g/liter of ferrous sulfate or ferrous ammonium sulfate as a main component ferrous salt, additionally incorporating 20 to 50 g/liter of boric acid and 1 to 10 g/liter of ferric sulfate as additives, and keeping a pH value at a level in the range between 2 and 5, preferably between 3 and 3.5.

3. A method according to claim 1, wherein said AC electrolysis in the step (A) of iron deposition subsequent to said anodic oxidation is carried out in an aqueous solution containing 10 to 200 g/liter of ferrous sulfate or ferrous ammonium sulfate as a main component ferrous salt, additionally incorporating 20 to 50 g/liter of boric acid, 0.5 to 10 g/liter of iron powder, and 0.1 to 1 g/liter of at least one organic acid selected from among tartaric acid, citric acid, gluconic acid, and malic acid as additives, and keeping a pH value at a level in the range between 3 and 6, preferably between 4.5 and 5.5.

4. A method according to claim 1, wherein said AC electrolysis in said step (A) of iron deposition is carried out at a voltage in the range between 5 and 35 V for a period in the range between 15 to 300 seconds to control the amount of the iron to be deposited and adjust the density of the producing blue color.

5. A method according to claim 1, wherein said DC electrolysis in said step (B) of DC electrolysis in said aqueous solution of hexacyano iron (II) acid salt is accomplished by placing said aluminum or aluminum alloy as an anode in an aqueous solution containing 1 to 100 g/liter of potassium ferrocyanide or ammonium ferrocyanide as a main component, additionally incorporating 20 to 50 g/liter of at least one inorganic strong electrolyte selected from among sodium sulfate, potassium sulfate, sodium chloride, and potassium chloride, and keeping a pH value at a level in the range between 2 and 10, preferably between 5 and 7 and applying a DC voltage of not less than 25 V to said aluminum or aluminum alloy.

6. A method for the impartation of clear and dense blue color to aluminum or an aluminum alloy, comprising the step (A) of forming an anodic oxide film on said aluminum or aluminum alloy by DC electrolysis as conventionally practised and subsequently subjecting the resultant anodized aluminum or aluminum alloy to immersion in sulfuric acid or phosphoric acid or to electrolysis in phosphoric acid or a mixed solution of phosphoric acid and sulfuric acid thereby performing a pore-widening treatment thereon, the step (B) of subjecting said aluminum or aluminum alloy to AC electrolysis in an aqueous solution containing an inorganic ferrous salt as a main component thereof thereby inducing deposition of iron in the pores of said anodic oxide film, and the step (C) of placing said aluminum or aluminum alloy as an anode in an aqueous solution containing hexacyano iron (II) acid salt as a main component and subjecting the same to DC electrolysis therein.

7. A method according to claim 6, wherein said AC electrolysis in the step (B) of iron deposition subsequent to said pore-widening treatment is carried out in an aqueous solution containing 10 to 200 g/liter of ferrous sulfate or ferrous ammonium sulfate as a main component ferrous salt, additionally incorporating 20 to 50 g/liter of boric acid and 1 to 10 g/liter of ferric sulfate as additives, and keeping a pH value at a level in the range between 2 and 5. preferably between 3 and 3.5.

8. A method according to claim 6, wherein said AC electrolysis in the step (B) of iron deposition subsequent to said pore-widening treatment is carried out in an aqueous solution containing 10 to 200 g/liter of ferrous sulfate or ferrous ammonium sulfate as a main component ferrous salt, additionally incorporating 20 to 50 g/liter of boric acid, 0.5 to 10 g/liter of iron powder, and 0.1 to 1 g/liter of at least one organic acid selected from among tartaric acid, citric acid, gluconic acid, and malic acid as additives, and keeping a pH value at a level in the range between 3 and 6, preferably between 4.5 and 5.5.

9. A method according to claim 6, wherein said AC electrolysis in said step (B) of iron deposition is carried out at a voltage in the range between 5 and 35 V for a period in the range between 15 to 300 seconds to control the amount of the iron to be deposited and adjust the density of the producing blue color.

10. A method according to claim 6, wherein said DC electrolysis in said step (C) of DC electrolysis in said aqueous solution of hexacyano iron (II) acid salt is accomplished by placing said aluminum or aluminum alloy as an anode in an aqueous solution containing 1 to 100 g/liter of potassium ferrocyanide or ammonium ferrocyanide as a main component, additionally incorporating 20 to 50 g/liter of at least one inorganic strong electrolyte selected from among sodium sulfate, potassium sulfate, sodium chloride, and potassium choride, and keeping a pH value at a level in the range between 2 and 10, preferably between 5 and 7 and applying a DC voltage of not less than 25 V to said aluminum or aluminum alloy.

* * * * *